US009777511B2

(12) United States Patent
Taylor et al.

(10) Patent No.: US 9,777,511 B2
(45) Date of Patent: Oct. 3, 2017

(54) LOCKING DEVICE

(71) Applicant: LOWE & FLETCHER LIMITED, Wednesbury (GB)

(72) Inventors: Colin J. Taylor, Pelsall (GB); James A. Gould, Brierly Hill (GB); Andrew D. Shorthouse, Pelsall (GB)

(73) Assignee: Lowe & Fletcher Limited, West Midlands (GB)

( * ) Notice: Subject to any disclaimer, the term of this patent is extended or adjusted under 35 U.S.C. 154(b) by 0 days.

(21) Appl. No.: 14/693,617

(22) Filed: Apr. 22, 2015

(65) Prior Publication Data

US 2016/0312496 A1 Oct. 27, 2016

(51) Int. Cl.

| | |
|---|---|
| ***E05B 47/00*** | (2006.01) |
| ***E05B 49/00*** | (2006.01) |
| ***E05B 65/02*** | (2006.01) |
| ***E05B 9/08*** | (2006.01) |

(52) U.S. Cl.

CPC ..... *E05B 49/00* (2013.01); *E05B 9/08* (2013.01); *E05B 65/025* (2013.01); *E05B 2047/0048* (2013.01); *E05B 2047/0086* (2013.01); *E05B 2047/0091* (2013.01)

(58) Field of Classification Search

CPC ..... E05B 49/00; E05B 2047/0048; E05B 2047/0084; E05B 2047/0085; E05B 2047/0086; E05B 65/025; E05B 9/08; E05B 2047/0091; Y10T 70/7107

USPC ..... 70/279.1, 277, 278.1, 278.7, 280–283, 70/283.1

See application file for complete search history.

(56) References Cited

U.S. PATENT DOCUMENTS

| | | | | | |
|---|---|---|---|---|---|
| 4,714,030 | A | * | 12/1987 | Cole | G07C 9/0069 109/59 T |
| 4,745,785 | A | * | 5/1988 | Uebersax | E05B 47/0012 70/279.1 |
| 4,901,545 | A | * | 2/1990 | Bacon | E05B 13/10 70/207 |
| 4,936,122 | A | * | 6/1990 | Osada | E05B 47/0673 70/214 |
| 4,956,984 | A | * | 9/1990 | Chi-Cheng | E05B 47/068 70/277 |
| 4,967,305 | A | * | 10/1990 | Murrer | E05B 47/068 340/5.54 |
| 5,113,675 | A | * | 5/1992 | Uyeda | E05B 13/10 292/358 |
| 5,410,898 | A | * | 5/1995 | Shieh | B60R 25/20 70/271 |

(Continued)

FOREIGN PATENT DOCUMENTS

| | | | |
|---|---|---|---|
| DE | 102009057188 A1 | | 5/2009 |
| EP | 2551427 | * | 1/2013 |
| WO | 2008/157663 A1 | | 12/2008 |

*Primary Examiner* — Lloyd Gall

(74) *Attorney, Agent, or Firm* — Greenberg Traurig, LLP

(57) ABSTRACT

A locking device (40) including a first module (42) and a second module (44), one of the first module (42) and the second module (44) being attachable to a first face (22*a*) of a door panel (22) of an enclosure (10) to be locked and the other of the first module (42) and the second module (44) being attachable to a second face (22*b*) of a door panel (22) of an enclosure (10) to be locked, wherein the locking device (40) includes a mechanical locking mechanism (60) and an electronic locking mechanism (46).

23 Claims, 2 Drawing Sheets

(56) References Cited

U.S. PATENT DOCUMENTS 5,421,178 A * 6/1995 Hamel ..... E05B 47/0661 292/144
5,473,236 A * 12/1995 Frolov ..... E05B 47/0012 318/265
5,493,882 A * 2/1996 Jasper ..... G07C 9/00912 70/278.4
5,685,182 A * 11/1997 Chhatwal ..... E05B 17/22 292/144
5,791,178 A * 8/1998 Chamberlain ..... E05B 13/106 70/277
5,862,693 A * 1/1999 Myers ..... E05B 47/0002 292/144
5,987,945 A * 11/1999 Ruano Aramburu ..... E05B 47/0692 70/107
6,264,256 B1 * 7/2001 Hankel ..... E05B 47/0615 292/336.3
6,568,230 B1 * 5/2003 Chen ..... E05B 45/10 200/43.08
6,622,537 B2 * 9/2003 Rodriguez ..... E05B 17/10 362/100
8,006,525 B2 * 8/2011 Huang ..... E05B 47/068 70/107
8,141,400 B2 * 3/2012 Sorensen ..... E05B 47/068 340/5.54
8,375,752 B2 * 2/2013 Chang ..... E05B 37/0031 70/162
8,490,445 B2 * 7/2013 Chiou ..... E05B 47/0012 70/224
8,616,031 B2 * 12/2013 Ullrich ..... E05B 47/0012 70/278.7
8,904,837 B1 * 12/2014 Lin ..... E05B 47/026 109/59 R
9,487,971 B2 * 11/2016 Quach ..... E05B 47/0012
2002/0125992 A1 * 9/2002 Harwood ..... E05B 47/0657 340/5.51
2005/0044908 A1 * 3/2005 Min ..... E05B 47/0012 70/276
2006/0037373 A1 * 2/2006 Case ..... E05B 15/02 70/278.1
2007/0157684 A1 * 7/2007 Bogdanov ..... E05B 47/0692 70/279.1
2007/0209413 A1 * 9/2007 Dobbs ..... E05B 13/005 70/279.1
2009/0133454 A1 * 5/2009 Frolov ..... E05B 47/0692 70/279.1
2013/0192316 A1 * 8/2013 McKibben ..... E05B 47/0001 70/278.1

* cited by examiner

LOCKING DEVICE

This invention relates to a locking device, in particular, but not exclusively to a locking device for an enclosure, including a mechanical locking mechanism and electronic locking mechanism.

BACKGROUND OF THE INVENTION

It is known in the art of lock making and fitting, to provide electronic locks which include a first module which is attachable to an outside of an enclosure to be locked, and a second module which is attachable to an inside of the enclosure to be locked. In the case of electronic locks, it is necessary for electronic communication between the two modules to be possible, to enable locking and unlocking of the lock. Providing a locking mechanism as part of the second module, i.e. which is positioned inside the enclosure protects the locking mechanism from intentional or accidental damage. There are two primary methods of electronically connecting the two modules of such a lock. The first involves one or more electrical cables or 'flying leads' to be connected between the first module and the second module. Such a cable is passed through an aperture in the enclosure to be locked, so as to be able to be electrically connected to both the first module and the second module. Connection between such a cable and each of the two modules is usually by way of a proprietary plug and connector, one of which is attached to the cable, and the other of which is attached to one of the modules. A disadvantage of this method of connection is that the connection can be difficult to achieve, owing to the need to pass the cable through an aperture in the enclosure to be locked before it can be connected to at least one of the modules. During this process, the two modules need to be supported, as they are typically attached to the respective part of the enclosure after the connection between the modules, via, the cable, has been completed. A further disadvantage of this method is that such a cable is prone to damage which may be caused, for example, by contact with the edge of the enclosure, or movement of adjacent mechanical elements of the enclosure, for example hinges.

The second primary method of connection is to use a so-called pin header and strip socket. In this method, one of the modules is provided with a rigid connector known in the art as a pin header. The other of the two modules is provided with a strip socket. Each of the pin header and the strip socket is directly attached, for example by soldering, to one of the two modules. A disadvantage of this method of connection is that the connector is not tolerant of significant variation in panel thicknesses between different enclosures. An additional problem, where a connector is required for use with an enclosure having relatively thick panels, is that the pin head is required to have relatively long pins, to permit electrical connection with the strip socket. Such long pins are prone to damage, for example during the assembly process.

Furthermore, some enclosure panels have an established pattern of apertures which are used for fixing the locking mechanism, and for access for connecting parts of the mechanism. A large proportion of lockers in the US, for example lockers in changing rooms and schools, adhere to a particular established pattern of apertures which enable mechanical locking of the locker, for example by means of a combination lock, and or a cylinder or tumbler lock, in which a central part or parts of the lock is/are required to rotate. The adoption of this pattern is substantially universal amongst lockers provided in the US.

It is undesirable to have to modify an enclosure panel, for example by providing more apertures, or by enlarging one or more of the apertures, to replace the lock, for example to provide an improved lock.

BRIEF SUMMARY OF THE INVENTION

In accordance with a first aspect of the invention, there is provided a locking device including a first module and a second module, one of the first module and the second module being attachable to a front face of a door panel of an enclosure to be locked and the other of the first module and the second module being attachable to a rear face of the door panel of an enclosure to be locked, wherein the locking device includes a mechanical locking mechanism and an electronic locking mechanism.

The locking device may include an electronic connection between the first module and the second module to enable electronic communication between the first module and the second module.

The electronic connection between the first module and the second module may include at least one connecting member.

The electronic connection may include a connecting member which includes a portion which is at least one of flexible, semi-flexible and resilient.

The locking device may include a plurality of connecting members, each including at least a portion which is at least one of flexible, semi-flexible and resilient.

A part of the mechanical locking mechanism and a part of the electronic locking mechanism may be arranged so as to simultaneously fit through an aperture in a panel of an enclosure, the aperture being of predetermined size.

The aperture may be approximately 11/16".

The at least one connecting member may be supported by a guide member.

At least part of the guide member may be provided by a body of the mechanical locking mechanism.

A part of the electronic locking mechanism may be arranged around at least a part of the mechanical locking mechanism.

At least a part of the mechanical locking mechanism and at least a part of the electronic locking mechanism may be arranged substantially concentrically with one another.

According to a second aspect of the invention, there is provided a method of installing a locking device in a panel of an enclosure, the method including simultaneously or substantially simultaneously inserting at least a part of a mechanical locking mechanism and at least a part of an electronic locking mechanism through an aperture in the panel.

The aperture may be pre-formed in the panel.

The aperture in the panel may have a predetermined diameter.

The method may include deforming, flexing bending or otherwise moving at least a part of an electronic connecting member before and/or during insertion of the locking device in the aperture in the panel.

The panel may be a door panel.

The method may include removing an existing locking device from the enclosure and replacing the existing locking device with a locking device including a first module and a second module, one of the first module and the second module being attachable to a front face of the panel and the other of the first module and the second module being attachable to a rear face of the panel, wherein the locking device includes a mechanical locking mechanism and an electronic locking mechanism.

BRIEF DESCRIPTION OF THE DRAWINGS

The invention will now be described by way of example only, with reference to the accompanying drawings, of which.

DETAILED DESCRIPTION OF THE INVENTION

Figures 1A, 1B:
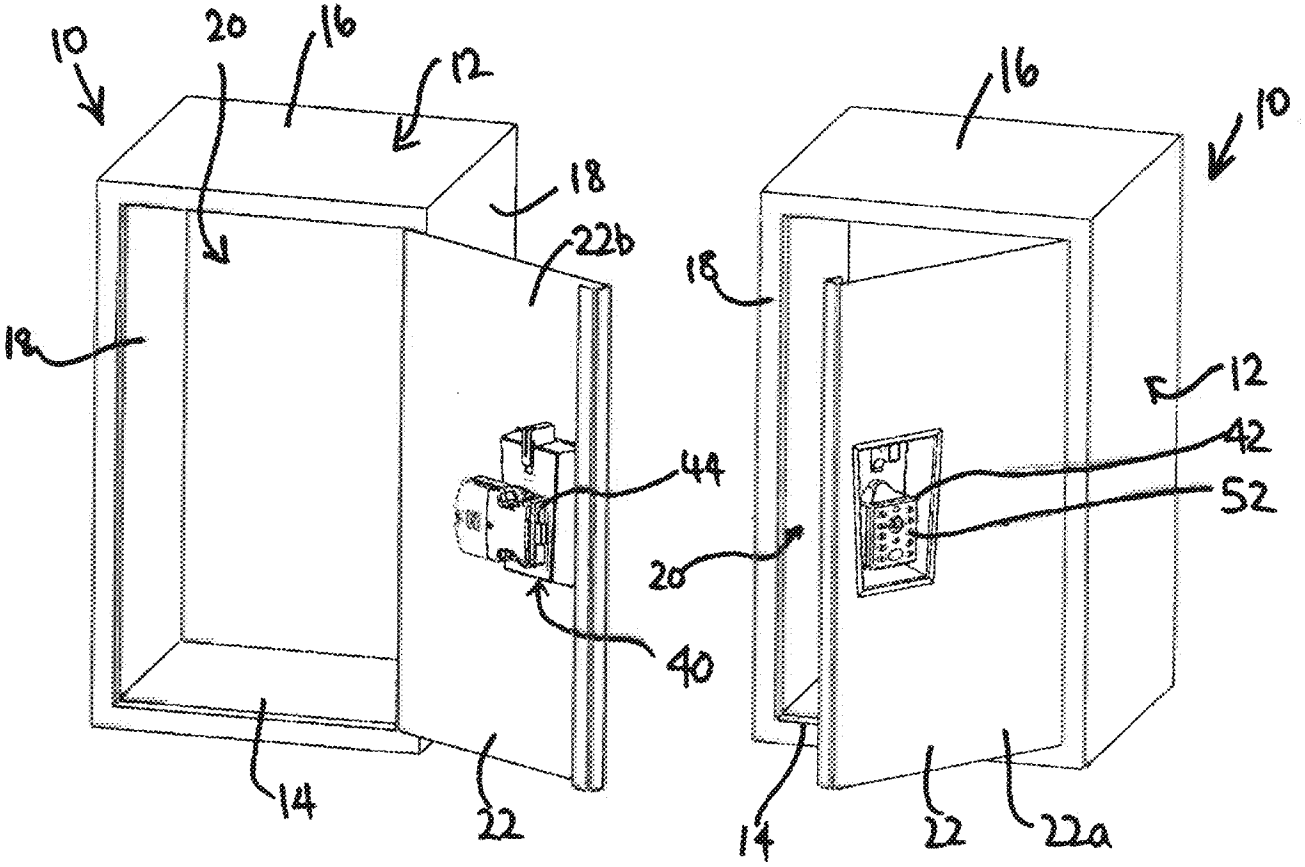
FIG. 1A is an illustrative view of an enclosure to be locked, showing an inner face of a door of the enclosure, and including an illustrative view of a part of a locking device in accordance with the invention.
FIG. 1B is an illustrative view of the enclosure of FIG. 1A, showing an outer face of the door of the enclosure, and another part of the locking device.

Referring to FIGS. 1A and 1B, there is shown an enclosure 10, which includes an enclosure body 12 which includes a base 14, an upper panel 16 and at least one wall panel 18 which extends between the base 14 and the upper panel 16. The enclosure body 12 also includes an opening 20 which is formed by the at least one wall panel 18. In embodiments, the enclosure body 12 includes a plurality of wall panels 18, and the opening 20 extends between two or more of the wall panels 18. It will be appreciated that a typical enclosure will be substantially cuboid, but an enclosure may be any shape and size, as appropriate, and the shape and/or volume may be defined by the shape, size and number of the wall panels 18, and/or the base 14 and/or the upper panel 16. The features of the locking device of the invention, as described below, are not dependent upon the number, shape or size of the wall panel(s) 18, base 14 or upper panel 16 of an enclosure with which it is intended for use. It will be appreciated that one or more of the wall panel(s), base 14, and/or upper panel 16 may be provided by a structural form, for example a wall, ceiling or floor of a building in which the enclosure is to be installed.

The enclosure 10 also includes a door panel 22 for covering the opening 20. The door panel 22 is of an appropriate size and shape to substantially fill the opening 20. The door 22 may overlap one or more edges of the opening 20, as defined by the at least one wall panel 18. The door 22 is attached to the body 12 of the enclosure 10 so as to permit movement of the door panel 22 between an open position relative to the enclosure 10, in which access to an interior of the body 12 of the enclosure 10 is permitted, and a closed position, in which the opening 20 is substantially covered by the door panel 22. The door panel 22 may be attached to the body 12 of the enclosure 10 by one or more hinges, for example. It will be appreciated that other methods of attachment may be appropriate. The door panel 22 is advantageously lockable in its closed position relative to the body 12 of the enclosure 10 to provide a secure location, for example for personal belongings. The door panel 22 has a front face 22*a*, which forms an external surface of the door panel 22, and a rear face 22*b*, which forms an internal surface of the door panel 22, i.e. is positioned on an interior of the enclosure 10 when the door panel 22 is closed relative to the body 12 of the enclosure 10.

The enclosure 10 may be an existing enclosure, which includes a locking device to be replaced. It may be desirable to be able to adapt the enclosure from being lockable by virtue of a single locking mechanism to an enclosure which is lockable by virtue of a dual electronic and mechanical locking mechanism.

Figure 2:
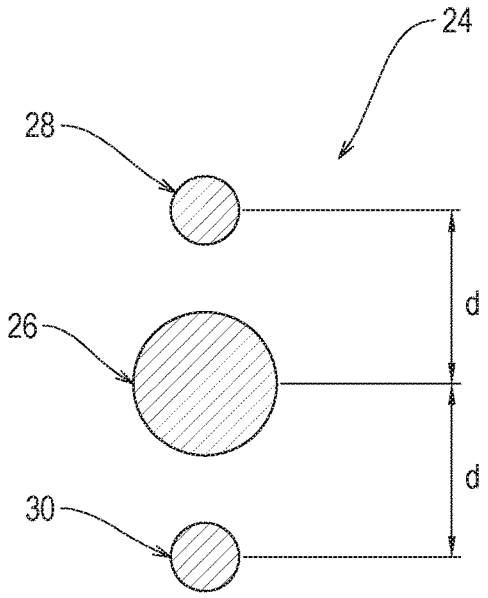
FIG. 2 is an illustrative view of common aperture pattern in an enclosure panel.

The enclosure 10 includes a pattern 24 of apertures, which are provided in the door panel 22. As shown in FIG. 2, the pattern 24 includes a first aperture 26, a second aperture 28 and a third aperture 30, each of which extends though the thickness of the door panel 22. The first aperture 26 of the pattern is typically provided to enable the passage of at least a part of a mechanical or electronic locking mechanism therethrough, to enable the door panel 22 to be secured to an adjacent wall panel 18 of the enclosure 10. For example, in the case of an electronic locking mechanism, the first aperture 26 may permit the passage of one or more flying leads or the pins of a pin header to pass therethrough so as to enable electrical connection between a first module 42 of the locking mechanism, provided on the front face 22*a* of the door 22, and a second module 44 of the locking mechanism 40 provided on the rear face 22*b* of the door 22. In the case of an existing mechanical locking mechanism, the first aperture 26 may receive the body of a cylinder lock or combination lock.

The second and third apertures 28, 30 are provided to enable the passage of fixings, for example screws or bolts, through the door panel, so as to permit the attachment of at least a part of a locking mechanism to the door panel 22. In the example shown the first aperture 26 is positioned between the second and third apertures 28, 30, and the first aperture 26 is larger than the second and third apertures 28, 30. In an embodiment, the first aperture 26 has a diameter of approximately 11/16" (17 mm), and the second and third apertures 28, 30 each have a diameter of approximately 3/16" (5 mm). The distance d between the centre of the first aperture 26 and the centre of each of the second and third apertures 28, 30 is approximately 1⅛" (28 mm). This pattern of apertures is a common configuration found in panels of enclosures, for example lockers, of known type, such enclosures being especially popular in the USA. It will be appreciated that the invention may be applicable to aperture patterns having other configurations.

It is desirable to permit enclosures which have this pattern of apertures or a similar pattern of apertures to be adapted to include additional locking capabilities. For example it may be desirable to adapt an enclosure to include both an electronic locking mechanism and a mechanical locking mechanism, for example to enable mechanical 'override' of a primarily electronic locking mechanism It is desirable not to have to modify the aperture pattern to carry out the adaptation.

It is advantageous to provide a dual-mechanism locking device, which permits locking by virtue of a mechanical and/or electronic mechanism. In an enclosure 10 which includes the common aperture pattern 24, it is awkward, if not impossible, to fit both a known electrical connector and a mechanical locking mechanism through the first aperture 26.

Figure 3:
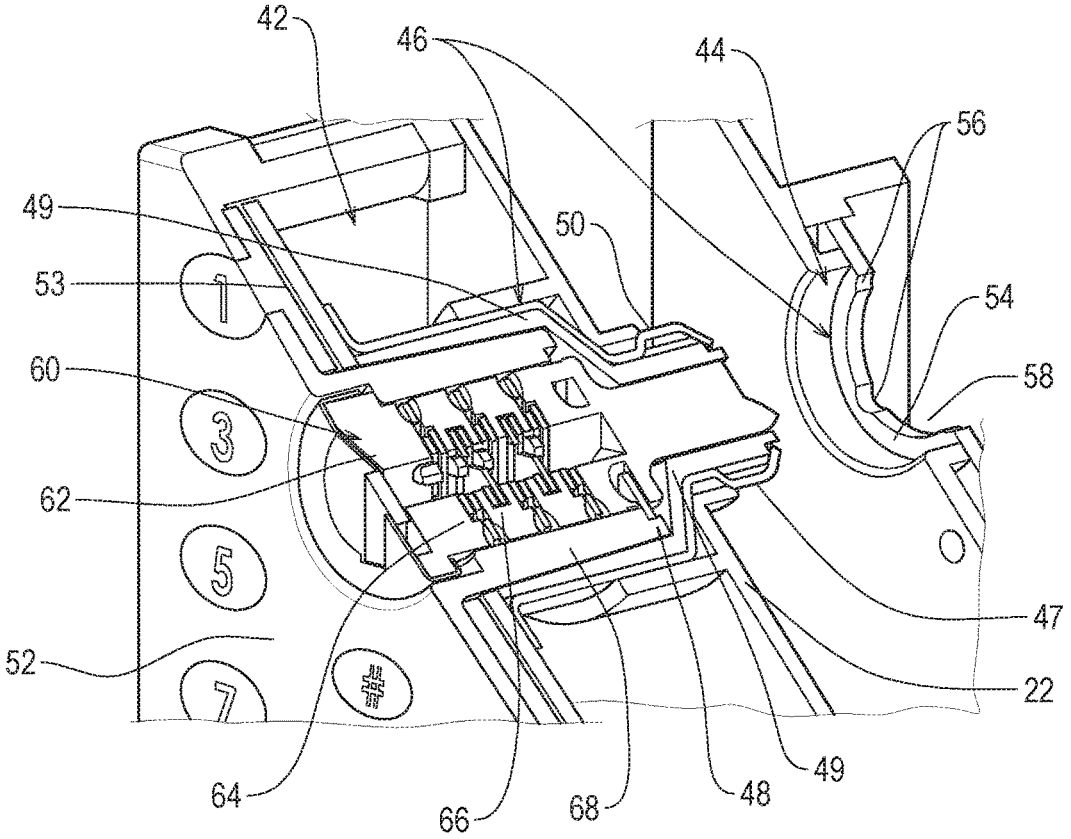
FIG. 3 is a cut-away perspective view of a locking device in accordance with the present invention.

Referring to FIG. 3, there is shown an embodiment of a locking device 40 in accordance with the invention. The locking device 40 includes a first module 42 and a second module 44. In the example shown, the first module 42 includes a body 48 which is attachable to the front face 22*a* the door 22 of the enclosure 10. The second module 44 is attachable to the rear face 22*b* of the door panel 22. The locking device 40 is compatible with the common pattern 24 of apertures.

The locking device 40 includes an electronic locking mechanism 46. The first module 42 is electrically and electronically communicable with the second module 44 by virtue of a connector 47. The connector 47 includes at least one connecting member 50. The or each connecting member 50 may be a wire. The or each connecting member 50 may be a metallic strip. The or each connecting member 50 may include a metallic element.

The or each connecting member 50 may be flexible or semi-flexible or may include a flexible or semi-flexible portion. The or each connecting member 50 may be substantially resilient or include a resilient portion. In the example shown in FIG. 3, the connector 47 includes a plurality of connecting members 50, each being in the form of a spring wire. FIG. 3 shows a cut-away perspective view of the locking device 40, therefore, not all parts are visible, however, it will be understood that in the embodiment shown there are four connecting members 50 (only two of which are visible in FIG. 3) which are substantially evenly spaced around an external surface of the body 48 of the first module. In the embodiment shown in FIG. 3, the four connecting members 50 are spaced substantially 90° apart. The connector may include any number of connecting members 50, which may extend around any portion of the external surface of the body 48, as appropriate.

The first module 42 includes a guide member 49 which supports the or each connecting member 50. The guide member 49 may be provided by at least a part of the external surface of the body 48. The guide member 49 may be integral with the body 48. The guide member 49 may include a plurality of portions, each of which supports a corresponding connecting member 50. The body 48 and/or the guide member 49 may be substantially hollow. The body 48 and/or the guide member 49 may be substantially cylindrical. At least a part of the guide member 49 may be rigid, or semi rigid, to support the or each connecting member 50. The guide member 49 supports the or each connecting member 50 during assembly of the locking device 40, and during installation of the locking mechanism in an enclosure. The or each connecting member 50 may conform to the outer surface of the guide member 49 over at least a part of its length. A portion of the or each connecting member 50 which is flexible/semi-flexible/resilient may be configured so as to be spaced from a corresponding part of the guide member 49, in a substantially radial direction, so as to enable movement or deflection of at least the portion of the or each connecting member 50 in a substantially radial direction relative to the guide member 49. The or each connecting member 50 may be curved or bent so as to provide a space between the or each connecting member 50 and the guide member 49. The or each connecting member 50 may be arranged substantially concentrically around the body 48 and/or the guide member 49.

The first module 42 also includes a user interface 52. In the example shown, the user interface includes a key pad, including a plurality of manually depressible buttons, via which a code, or other input, may be completed by a user. It will be appreciated that the user interface may be of an alternative type, as appropriate, for example a touchscreen, biometric recognition unit, etc. The first module 42 may include a circuit board 53 which receives inputs from the user interface 52, and provides outputs to be transmitted to the second module 44.

The or each connecting member 50 enables electrical and/or electronic communication between the first module 42 and the second module 44 of the locking device 40. The second module 44 includes a circuit board 54, which is configured to receive an electrical input from the first module 42, for example a code input via the user interface 52, and transmitted via the circuit board 53 of the first module 42. The circuit board 54 of the second module 44 includes at least one contact 56 via which an electrical connection between the first module 42 and the second module 44 is established. The circuit board 54 of the second module 44 may include a plurality of contacts 56. In the example shown in FIG. 3, the circuit board includes four contacts 56 (only three of which are visible in FIG. 3), each of which is connectable with a corresponding connecting member 50 of the first module 42. The or each contact 56 may be an opening, for example a cut-out, castellation, or port in which a connecting member 50, or part of a connecting member 50 is receivable.

In the example shown, the contacts 56 are substantially evenly circumferentially spaced around an aperture 58 in the circuit board 54. It will be appreciated that the contacts 56 need not be provided directly on the circuit board 54, although this provides a convenient configuration. It will be appreciated that a single contact 56 which is communicable with the or each conducting member 50 may be provided. A single contact 56 may extend around substantially the entire perimeter of the aperture 58 in the circuit board 54. Where no aperture 58 is provided, the or each contact 56 is positioned so as to establish contact with a corresponding connecting member 50 of the first module 42. The or each contact 56 may be coated with a highly electrically conductive material, for example gold. The or each contact 56 may be moveable relative to the circuit board 54, for example the or each contact 56 may include a biasing member which biases the respective contact 56 into a rest position, but which is deflectable, for example by a connecting member 50, into a second position. The mobility of the or each contact 56 may ensure sufficient electronic communication between the or each contact 56 and the or each corresponding connecting member 50.

The flexibility or resilience of the or each connecting member 50 enables a degree of 'play', i.e. slight relative movement between, and/or misalignment of the first and second modules 42, 44, whilst still enabling an electrical connection to be established between the two modules 42, 44. The flexibility or resilience of the or each connecting member 50 also reduces the risk of damage to the or each connecting member 50 during at least one of assembly, installation and use. The guide member 49 also provides protection against damage of the or each connecting member 50, for example by inhibiting permanent deflection of the or each connecting member 50.

In addition to the electronic locking mechanism 46, the locking device 40 includes a mechanical locking mechanism 60. In the example shown in FIG. 3, the mechanical locking mechanism 60 is shown as a barrel or cylinder lock 62, which includes a set of tumbler pins which can be maneuvered by a key, to enable rotation of a central barrel 66 relative to an outer body 68, in a known fashion. The mechanical locking mechanism is configured to fit through the first aperture 26 of the door panel 22. It will be appreciated that alternative types of mechanical locking mechanism may be provided, as appropriate, for example a combination lock. The mechanical locking mechanism 60 may provide an override mechanism for the electronic locking mechanism of the locking device 40.

In the embodiment shown in FIG. 3, at least a part of the body 48 of the first module 42 substantially coincides with the body 68 of the mechanical locking mechanism 60. The barrel 66 of the mechanical locking mechanism 60 is substantially coaxial with the body 48 of the first module 42, and body 68 of the mechanical locking mechanism 60 may be integral with the body 48 of the first module 42. At least one of the body 48 and the guide member 49 of the first module 42 being substantially hollow enables the mechanical locking mechanism 60 to extend through the body 48 and/or the guide member 49. Thus, the or each connecting member 50 is positioned on or adjacent an outer surface of the mechanical locking mechanism 60. The mechanical locking mechanism 60 is substantially concentric with at least a part of the electronic locking mechanism 46. The mechanical locking mechanism 60 may be concentric with the body 48 and/or the guide member 49 and/or the or each connecting member 50. It will be appreciated that the mechanical locking mechanism 60 and the guide member 49 may lie adjacent one another, rather than the mechanical locking mechanism 60 passing through the guide member 49 and/or the body 48.

The or each connecting member 50 which establishes an electrical connection between the first module 42 and the second module 44, and the mechanical locking mechanism are configured such that they are both able to pass through the first aperture 26 of the door panel 22 simultaneously, without requiring enlargement of the first aperture 26, and without damaging either the electronic locking mechanism 46, in particular the or each connecting member 50, or the mechanical locking mechanism 60.

In use, the locking device 40 is installed in an enclosure to be locked 10, with the first module 42 attached to the front face 22*a* of the door panel 22 of the enclosure 10, and the second module 44 attached to the rear face 22*b* of the door panel 22. The user interface 52 is positioned on the front face 22*a* of the door panel 22 for access by a user of the enclosure 10. At least a part of the body 48 of the first module 42 and at least a part of the guide member 49 extend through the first aperture 26 of the door panel 22. The or each connecting member 50 extends through the first aperture 26 in the door panel 22, and a part of the or each connecting member 50 extends beyond the rear face 22*b* of the door panel 22, so as to protrude from the rear face 22*b* of the door panel 22, to enable connection to the second module 44 of the locking device 40. The guide member 49 may also extend beyond the rear face 22*b* of the door panel 22, so as to support the or each connecting member 50.

During installation in the door panel 22, the or each connecting member 50 may be defected, flexed, or otherwise moved, relative to the body 48, for example so as to more closely conform to the shape of the guide member 49, to enable the or each connecting member 50, the guide member 49, the body 48 and the mechanical locking mechanism 60 to be received in and through the first aperture 26 in the door panel 22 simultaneously, or substantially simultaneously.

The part of the or each connecting member 50 which extends beyond the rear face 22*b* of the door panel 22 comes into electrical contact with the or each corresponding contact 56 of the second module 44, which is positioned adjacent, and attachable to the rear face 22*b* of the door panel 22. Where an aperture 58 is provided in the second module 44, the or each connecting member 50 extends into the aperture 58, so as to permit electrical contact with the or each contact 56. The guide member 49 may also extend into the aperture 58 to support the or each connecting member 50, in use. The or each connecting member 50 and/or the or each contact 56 may bend, flex, deflect, resiliently move, be biased, or otherwise move relative to one or more of: the body 48 of the first module, the guide member 49, the circuit board 54, the aperture 58 in the circuit board 54 and each other, in order for the or each connecting member 50 to contact the or each corresponding contact, 56, so as to establish an electronic connection between the first module 42 and the second module 44.

Once the first module 42 has been installed in the door panel 22, and/or connected to the second module 44, the part of the or each connecting member 50 which protrudes from the door panel 22 may return to its original position relative to the guide member 49, for example owing to its inherent resilience, or where provided, through the action of a respective biasing member.

Each of the second and third apertures 28, 30 is used to receive a fixing, for example a screw or a bolt, to retain the first module 42 and the second module 44 in their respective positions relative to the door panel 22.

When a user wishes to lock and/or unlock the enclosure electronically, the user inputs a code or other signal via the user interface 52. The circuit board 53 of the first module 42 receives the input and transmits a corresponding signal to the circuit board 54 of the second module 44, via the or each connecting member 50. The circuit board 54 of the second module 44 receives the signal and controls the electronic locking mechanism accordingly, for example by locking or unlocking the door panel 22 relative to the body 12 of the enclosure 10, or by maintaining the status quo, for example if an incorrect user input is used.

In a situation where mechanical locking or unlocking is required, a corresponding key is receivable in the mechanical locking mechanism 60, and is able to operate the cylinder lock. Such a situation may arise in the event of power failure, or if the electronic locking mechanism otherwise compromised, for example if the correct user input is forgotten or has been disclosed to someone other than the user of the enclosure.

It will be appreciated that neither, one or both of the or each connecting member 50 and the or each contact 56 may be at least one of flexible, semi-flexible, resilient and moveable. It will be understood that one or both of the or each connecting member 50 and the or each contact 56 may be at least one of rigid and fixed in position.

It will be appreciated that the or each connecting member 50 may have any cross-sectional shape.

Electrical connections between any part of the electronic locking mechanism may be achieved by contact between the corresponding parts. Each electrical connection may include a biasing member to bias corresponding parts into contact with one another. Electrical connections other than those between the or each connecting member 50 and the or each corresponding contact 56 may be permanent/semi-permanent, for example achieved by soldering.

An advantage of the present invention is that the locking device 40 may be retro-fitted into existing enclosure, without the requirement to modify the enclosure 10 or adjust the size of the first aperture 26 or second or third apertures, 28, 30 of a common pattern 24 of apertures, which is present in a large proportion of existing enclosures, i.e. lockers. It is possible to provide both mechanical and electronic locking in a single device 40 without the requirement to provide additional apertures in the panels to which the locking device 40 is to be fitted. Both the electronic locking mechanism 46 and the mechanical locking mechanism 60 fit through the same aperture 26 in the door panel 22 of the enclosure 10. Furthermore, the electronic connection 47 is less fragile than a flying lead arrangement or pin header arrangement and is compatible with a large range of panel thicknesses. The guide member 49 protects the electronic connection 47 from damage during assembly, installation and use, and therefore the locking device 40 is likely to be more durable than existing electronic locking mechanisms.

It will be appreciated that whilst the locking device 40 has been described as being attachable to a door panel 22 of an enclosure 10, it will be appreciated that the locking device 40 may be attached to any panel of an enclosure 10, as appropriate and/or as required. The common pattern 24 of apertures may be provided in any panel of a particular enclosure 10, and hence, the locking device 40 would be attachable to the or each panel having appropriate apertures provided therein.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A locking device comprising:

a first module configured to be attached to a front face of a panel of an enclosure to be locked, the first module comprising:

a mechanical locking mechanism; and an electronic locking mechanism;

a second module configured to be attached to a rear face of the panel of the enclosure to be locked;

a hollow guide member, wherein the mechanical locking mechanism is configured in size and shape to be able to extend through the hollow guide member; and an electronic connection pathway to enable electronic communication between the first module and the second module, wherein the electronic connection pathway comprises at least one electrically-conductive connecting member disposed on a surface of the guide member;

wherein the locking device defines an aperture configured to receive the guide member;

wherein the electronic connection pathway further comprises at least one electrical contact disposed on a surface defining the aperture; and wherein inserting the hollow guide member into the aperture causes the at least one connecting member to become electrically coupled with the at least one electrical contact to form the electronic connection pathway.

2. A locking device according to claim 1 wherein the at least one connecting member includes a portion which is at least one of flexible, semi-flexible, or resilient.

3. A locking device according to claim 2, comprising a plurality of connecting members, each including at least a portion which is at least one of flexible, semi-flexible, or resilient.

4. A locking device according to claim 1 wherein a part of the mechanical locking mechanism and a part of the electronic locking mechanism are arranged so as to simultaneously fit through a panel aperture in the panel of the enclosure, the aperture being of predetermined size.

5. A locking device according to claim 4 wherein the part of the mechanical locking mechanism and the part of the electronic locking mechanism are arranged so as to simultaneously fit through a panel aperture in the panel of the enclosure that is approximately 11/16".

6. A locking device according to claim 1 wherein at least part of the guide member comprises a body of the mechanical locking mechanism.

7. A locking device according to claim 1 wherein a part of the electronic locking mechanism is arranged around at least a part of the mechanical locking mechanism.

8. A locking device according to claim 1 wherein at least a part of the mechanical locking mechanism and at least a part of the electronic locking mechanism are concentric with one another.

9. A locking device according to claim 1, wherein the first module comprises the hollow guide member.

10. A locking device according to claim 1, wherein the aperture is defined by the second module.

11. A locking device according to claim 1, wherein the at least one connecting member comprises a spring wire or metallic strip.

12. A locking device according to claim 1, further comprising a circuit board defining the aperture.

13. A method of installing a locking device in a panel of an enclosure, the locking device comprising a first module and a second module, the method comprising:

simultaneously inserting at least a part of a mechanical locking mechanism and at least a part of an electronic locking mechanism through a panel aperture in the panel;

providing an electronic connection pathway to enable electronic communication between the first module and the second module, wherein the electronic connection pathway comprises at least one electrically-conductive connecting member; and guiding the at least one connecting member with a hollow guide member, wherein the mechanical locking mechanism is configured in size and shape to be able to extend through the hollow guide member;

wherein the at least one connecting member is disposed on a surface of the guide member;

wherein the locking device defines a device aperture configured to receive the guide member;

wherein the electronic connection pathway further comprises at least one electrical contact disposed on a surface defining the aperture; and wherein inserting the hollow guide member into the device aperture causes the at least one connecting member to become electrically coupled with the at least one electrical contact to form the electronic connection pathway.

14. A method according to claim 13 wherein the panel aperture is pre-formed in the panel.

15. A method according to claim 14 wherein the panel aperture in the panel has a predetermined diameter.

16. A method according to claim 13, further comprising deforming, flexing, or bending at least a part of an electronic connecting member before, during, or before and during insertion of the locking device in the panel aperture in the panel.

17. A method according to claim 13 wherein the panel is a door panel.

18. A method according to claim 13, wherein the locking device is a new locking device, further comprising removing an existing locking device from the enclosure and replacing the existing locking device with the new locking device, one of the first module and the second module being attachable to a front face of the panel and the other of the first module and the second module being attachable to a rear face of the panel.

19. A method according to claim 13, wherein the first module comprises the at least a part of the mechanical locking mechanism and the at least a part of the electronic locking mechanism.

20. A method according to claim 19, wherein the first module comprises the hollow guide member.

21. A method according to claim 13, wherein the device aperture is defined by the second module.

22. A method according to claim 13, wherein the at least one connecting member comprises a spring wire or metallic strip.

23. A method according to claim 13, wherein the device aperture is defined by a circuit board of the locking device.

* * * * *